US006379503B1

(12) United States Patent
Jansson

(10) Patent No.: US 6,379,503 B1
(45) Date of Patent: Apr. 30, 2002

(54) APPARATUS AND METHOD FOR MOUNTING AND DISMANTLING A WEAR BODY IN A PAPER MAKING MACHINE

(75) Inventor: Per Anders Jansson, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 09/813,199

(22) Filed: Mar. 20, 2001

Related U.S. Application Data

(63) Continuation of application No. PCT/SE99/01728, filed on Sep. 29, 1999.
(60) Provisional application No. 60/108,967, filed on Nov. 18, 1998.

(30) Foreign Application Priority Data

Oct. 9, 1998 (SE) ..... 9803441

(51) Int. Cl.[7] ..... D21F 1/48; D21F 1/54
(52) U.S. Cl. ..... 162/199; 162/352; 162/272
(58) Field of Search ..... 162/352, 374, 162/363, 199, 272

(56) References Cited

U.S. PATENT DOCUMENTS 4,559,105 A 12/1985 Sennett et al.
5,078,835 A 1/1992 Schiel et al.
5,129,992 A 7/1992 Schiel et al.
5,262,010 A * 11/1993 Bubik et al. ..... 162/352
5,486,270 A 1/1996 Schiel
5,507,918 A * 4/1996 Polifke et al. ..... 162/352

FOREIGN PATENT DOCUMENTS

DE 42 42 658 A1 6/1994

* cited by examiner

*Primary Examiner*—Karen M. Hastings
(74) *Attorney, Agent, or Firm*—Alston & Bird LLP

(57) ABSTRACT

Machine equipment in a paper or board machine comprising at least one wear ledge for contact with a clothing, and a support body for the wear ledge and a device for mounting the wear ledge to its support body. In accordance with the invention, the mounting device has a locking bar arranged in a groove in the wear ledge, and a cavity is formed in the support body and contains a press bar. The support body defines a plurality of holes extending from the cavity and open toward the groove in the wear ledge. Connecting elements extend through the holes and are rigidly connected to the clamping bar and the press bar, and spring members in the cavity act between the press bar and an opposite support surface of the cavity to retain the wear ledge against the support body in a stable operating position. An expandable hose is arranged in the cavity so as, when activated, to press against the press bar so that the spring members are compressed and the wear ledge becomes free for pulling out along the locking bar.

14 Claims, 3 Drawing Sheets

APPARATUS AND METHOD FOR MOUNTING AND DISMANTLING A WEAR BODY IN A PAPER MAKING MACHINE

CROSS-REFERENCE TO RELATED APPLICATION

This application claims the benefit of, inter alia, U.S. Provisional Patent Application Ser. No. 60/108,967 filed Nov. 18, 1998, and is a continuation of pending PCT International Application PCT/SE99/01728 filed Sep. 29, 1999, both of which are incorporated herein by reference.

FIELD OF THE INVENTION

The present invention relates to an apparatus and method for mounting and dismantling an elongate wear body adapted to slidably contact a clothing that travels in a loop in a paper making machine.

BACKGROUND OF THE INVENTION

Paper making processes often employ suction devices that slidably contact one surface of a wire, fabric, or other clothing the opposite surface of which may support a paper web for transporting the web through various devices in a paper making machine. Various types of suction devices are used, for example, for suctioning water from the paper web and clothing to dewater the web, or for suctioning water and fibers from a clothing after the web has been transferred from the clothing so as to clean the clothing. Suction devices typically include wear ledges that extend along the clothing in the cross-machine direction and have wear surfaces adapted to slidably contact the clothing. A known type of suction box has its wear ledges detachably mounted to support bodies by means of a plurality of bolts distributed along the suction box. The bolts are accessible from the long side of the suction box and, to detach the wear ledges, the wire or felt must be removed from the paper machine so that the bolts become accessible to be loosened and the wear ledges become exposed for removal and replacement with new wear ledges. This procedure is time-consuming and results in a considerable production fall-off.

To overcome these problems associated with the mounting and dismantling of the wear ledges, a suction box has been proposed in which each wear ledge is connected to the support body by means of longitudinal, cooperating elements in the shape of a T-groove in the wear ledge and a corresponding T-shaped protrusion in the support body so that the wear ledge can be removed from the support body by being moved in its longitudinal direction, i.e., in the cross-machine direction, whereupon a new wear ledge is slid onto the T-shaped protrusion to mount the wear ledge onto the support body. Relatively large clearance is necessary between the walls of the T-groove and the T-shaped protrusion to enable such a movement of the wear ledge. Consequently, vibrations can develop in the wear ledge during machine operation and the desired width of the suction gap in the suction box cannot be maintained.

U.S. Pat. No. 5,078,835 describes ledges for resilient support of a wire. Each ledge has a stationary support part and a part that is movable in relation thereto, which movable part is provided with a wear ledge on its outer, free end. The movable part is moved to its operating position by means of a pressure cushion that is pressurized and thereby caused to expand. When the pressure in the pressure cushion ceases, the wear ledge resumes its resting position by means of a spring. The movable part has a support body to which the wear ledge is detachably mounted by means of T-shaped grooves and protrusions. As the wear ledge is not rigidly mounted to the support body during operation, disturbing vibrations can develop in the wear ledge and be transmitted to the wire. Furthermore, if fluid pressure to the pressure cushion should fail during operation, the wear ledge will not be held in its desired operating position.

U.S. Pat. No. 5,129,992 describes a support with a wear ledge for a wire, and a locking device provided with a spring member or an inflatable body. The locking device, by means of a tensioned spring or an inflated body, clamps the wear ledge in its active position, the tilt angle of which is adjusted by way of wedge members. The wear ledge has a dovetail guide with either a large interspace or an additional low-friction layer to enable dismantling of the wear ledge. During operation, the wear ledge is not rigidly fixed in the dovetail guide.

U.S. Pat. No. 5,486,270 describes a foil with a locking device and a support for a wear ledge. The locking device comprises an inflatable body or a number of springs for fixing the wear ledge in an active position elevated from the support by inflating the body or tensioning the springs. The angle between the wear ledge and the wire can be adjusted by means of displaceable wedges arranged on the downstream side of the locking device. The wear ledge is mounted with a dovetail guide without being rigidly fixed during operation.

DE-A1-42 42 658 describes dewatering ledges that have rigid supports and pressure hoses arranged thereon, which pressure hoses, when inflated, retain the wear ledges in an operating position via a movable support body, on which the wear ledge is detachably mounted by means of T-shaped grooves and protrusions. As the wear ledge is not rigidly mounted on the support body during operation, disturbing vibrations can develop in the wear ledge and be transmitted to the wire. Additionally, if fluid pressure to the hoses should fail during operation, the wear ledges will not be retained in the desired operating positions.

U.S. Pat. No. 4,559,105 describes a foil that has a rigid support body and a wear ledge that is detachably mounted to the support body by means of T-shaped grooves and protrusions, which furthermore allow movement of the wear ledge in relation to the support body with the aid of an inflatable element that is arranged in the T-groove so as to act directly on the wear ledge and retain the same in its operative position. A risk of vibrations in the wear ledge is inherent in this construction and becomes especially serious when the inflatable element breaks or when, for any reason, its pressurization diminishes or ceases entirely.

SUMMARY OF THE INVENTION

The above needs are addressed by the present invention, which provides an apparatus for mounting a wear body in which the wear body is continuously urged by spring elements into a stable operating position in engagement with a support body, the spring elements causing a locking member to engage clamping surfaces of the wear body and lock it in the stable operating position, thereby eliminating or substantially reducing vibrations of the wear body during operation. For dismantling the wear body from its support body, an actuator is provided. The actuator is operable to move the locking member against the force of the spring elements so as to disengage the locking member from the clam ping surface s of the wear body. Preferably, the locking member comprises an elongate locking bar disposed in an elongate mounting track defined in the wear body. Accordingly, once the actuator is actuated and the locking bar is moved into a release position disengaged from the clamping surfaces, the wear body can be slid in the cross-machine direction so as to disengage it from the locking bar.

Thus, in accordance with a preferred embodiment of the invention, an apparatus for slidably contacting a clothing that carries a paper web and travels in a loop along a machine direction in a paper making machine includes an elongate support body extending in a cross-machine direction, the support body defining at least one cavity therein and at least one opening that extends into the cavity and is open facing the clothing. The apparatus further includes an elongate wear body supported on the support body and extending in the cross-machine direction, the wear body and support body defining opposing cooperative support surfaces, a wear surface of the wear body being adapted to slidably contact the clothing, the wear body defining a mounting track therein extending in the cross-machine direction, the mounting track defining clamping surfaces therein. A locking member is engaged in the mounting track of the wear body, the locking member being configured to be movable toward and away from the support body between a clamped position in engagement with the clamping surfaces of the mounting track and a release position disengaged from the clamping surfaces, the locking member in the release position being freely slidable within the mounting track in the cross-machine direction. At least one locking device is disposed in the cavity of the support body and has a connecting element extending through the opening and connected to the locking member, the connecting element being movable toward and away from the wear body, the locking device including a spring member connected between the support body and the connecting element and operable to apply a continuous force to the connecting element so as to bias the locking member into the clamped position in engagement with the clamping surfaces and thereby urge the wear body against the support surface of the support body to lock the wear body in a stable operating position. The locking device further includes an actuator disposed in the cavity of the support body and operable upon actuation thereof to move the connecting element against the force of the spring member so as to move the locking member into the release position to permit the wear body to be slidably dismantled from the apparatus.

Preferably, the cavity in the support body is elongated in the cross-machine direction, and a plurality of openings are defined in the support body extending from the cavity and open toward the clothing, the openings being spaced along the support body in the cross-machine direction. The locking device preferably includes an elongate press bar disposed in the cavity and a plurality of connecting elements connected to the press bar and extending through the openings in the support body and connected to the locking member. The locking device preferably also includes a spring member connected between each connecting element and the press bar for continuously biasing the connecting elements to urge the locking member into the clamped position.

In a preferred embodiment of the invention, the support surface of the support body faces toward the clothing and the support surface of the wear body faces away from the clothing, and the locking device is operable to retract the locking member away from the clothing to lock the wear body in a stable operating position and to extend the locking member toward the clothing to permit the wear body to be removed from the apparatus. The spring members advantageously comprise compression spring members disposed between a first surface of the press bar that faces the wear body and a surface of the support body that faces away from the wear body. The actuator is advantageously disposed between a second surface of the press bar that faces away from the wear body and a surface of the support body that faces toward the wear body. The actuator preferably comprises a fluid-actuated device such as an inflatable hose or the like, but may alternatively comprise an eccentric shaft that can be rotated to move the connecting elements against the force of the spring elements, a sealed pressure chamber formed in a portion of the cavity in the support body, or a plurality of small hydraulic or pneumatic cylinders disposed in the cavity. The spring members advantageously comprise a plurality of spring washers stacked one atop another, but may also comprise coil springs or the like.

In accordance with a further preferred embodiment of the invention, the wear body and the support body include cooperating guide elements configured to engage each other and guide the wear body into the stable operating position, the guide elements also fixing the wear body in a predetermined position in the machine direction relative to the support body. The guide element of the wear body preferably comprises a pair of wall sections defining opposing side surfaces spaced apart in the machine direction, the side surfaces defining an outer portion of the mounting track. The guide element of the support body preferably comprises a protrusion formed on the support body and configured to be received at least partially into the outer portion of the mounting track, the protrusion including opposite side surfaces configured to engage the side surfaces of the wall sections.

The invention also provides a method for mounting and removing an elongate wear body adapted to slidably contact a clothing that travels in a loop along a machine direction in a paper making machine, the wear body being of the type defining an elongate mounting track therein extending through at least one end of the wear body and along the wear body in a cross-machine direction and defining a wear surface adapted to slidably contact the clothing, the mounting track defining clamping surfaces therein, the mounting track defining an outer portion that is open at a surface of the wear body on an opposite side thereof from the wear surface. A method in accordance with a preferred embodiment of the invention comprises mounting the wear body by slidably inserting an elongate locking member into the mounting track, and continuously urging the wear body into engagement with an elongate support body configured to support the wear body in a stable operating position, the wear body being urged into the operating position by spring elements connected to the support body and to the locking member, the spring elements urging the locking member against the clamping surfaces so as to lock the wear body in the operating position. Dismantling the wear body is accomplished by actuating an actuator in operative engagement with the locking member so as to move the locking member against the force of the spring elements and disengage the locking member from the clamping surfaces, and sliding the wear body in the cross-machine direction relative to the locking member so as to disengage the wear body from the locking member.

The invention thus facilitates the stable mounting of the wear body during operation so that vibrations of the wear body are eliminated or substantially reduced, and yet the wear body can be easily dismantled by virtue of the locking member being freely slidable in the cross-machine direction within the mounting track when it is disengaged from the clamping surfaces by activation of the actuator. Moreover, the proper location of the wear body in its operating position does not depend on the proper functioning of a fluid-actuated device as in some prior devices.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
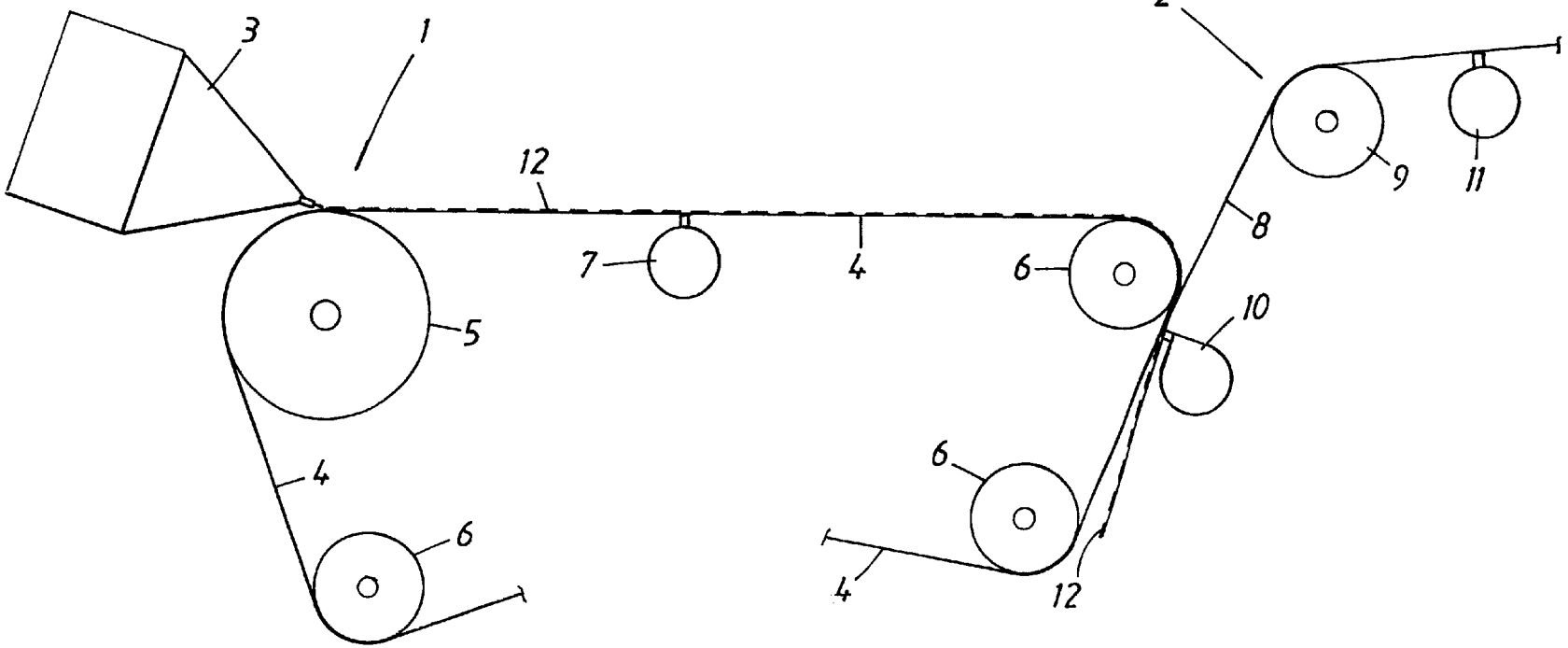
FIG. 1 schematically illustrates parts of a paper machine provided with various kinds of suction devices.

FIG. 1 shows parts of a paper machine, comprising a wet section 1, a press section 2 and a drying section (not shown). The wet section comprises a headbox 3 and a forming clothing 4, which runs in an endless loop around a forming roll 5 and guide rolls 6 and on which a web 12 is formed. In the loop of the forming clothing 4, there is a suction device 7 in the form of a dewatering suction box. The press section 2 comprises a press clothing 8, passing in a loop around a plurality of guide rolls 9 and through a press nip (not shown). The press clothing 8 runs in contact with the forming clothing 4 at a pick-up point for transferring the web from the forming clothing 4 to the press clothing 8. In the loop of the press clothing 8, there is a first suction device in the form of a pick-up suction shoe 10, arranged at said pick-up point, and a second suction device in the form of a suction box 11 for cleaning the press clothing 8. Said suction devices constitute examples of machine equipment in accordance with the invention that are arranged cross the machine direction in contact with the clothing 4, 8.

Figure 2:
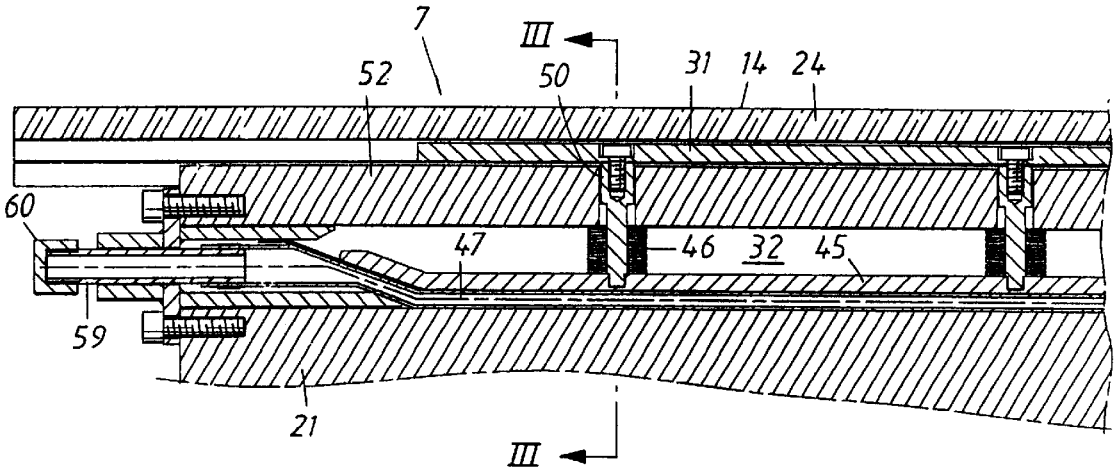
FIG. 2 is a longitudinal sectional view of an end portion of a suction box with mounting devices in accordance with a preferred embodiment of the invention.
Figure 3:
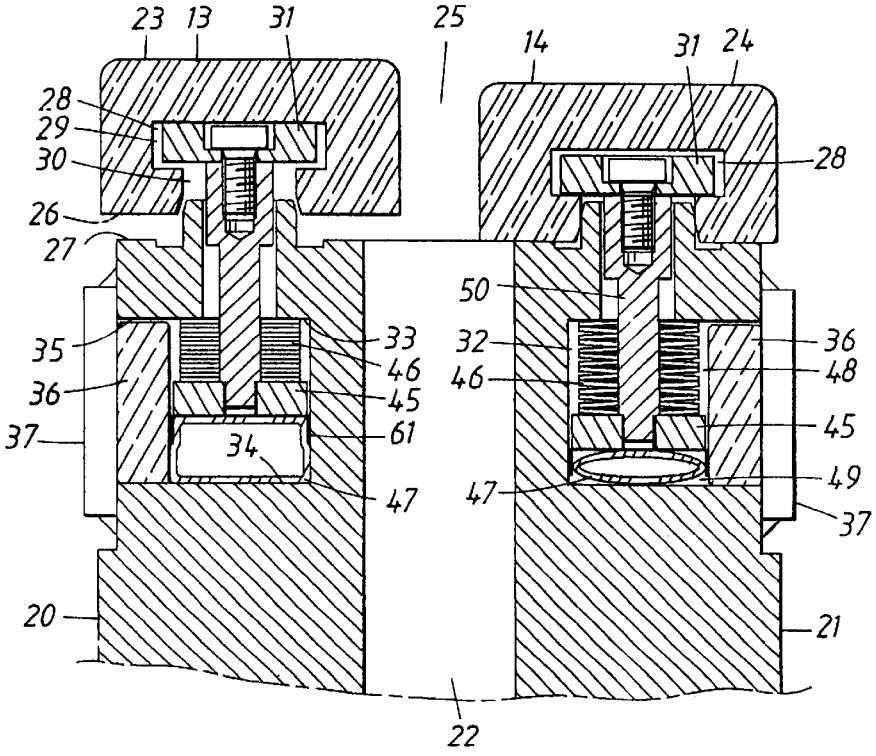
FIG. 3 is a cross section along the line III—III in FIG. 2.
Figure 4:
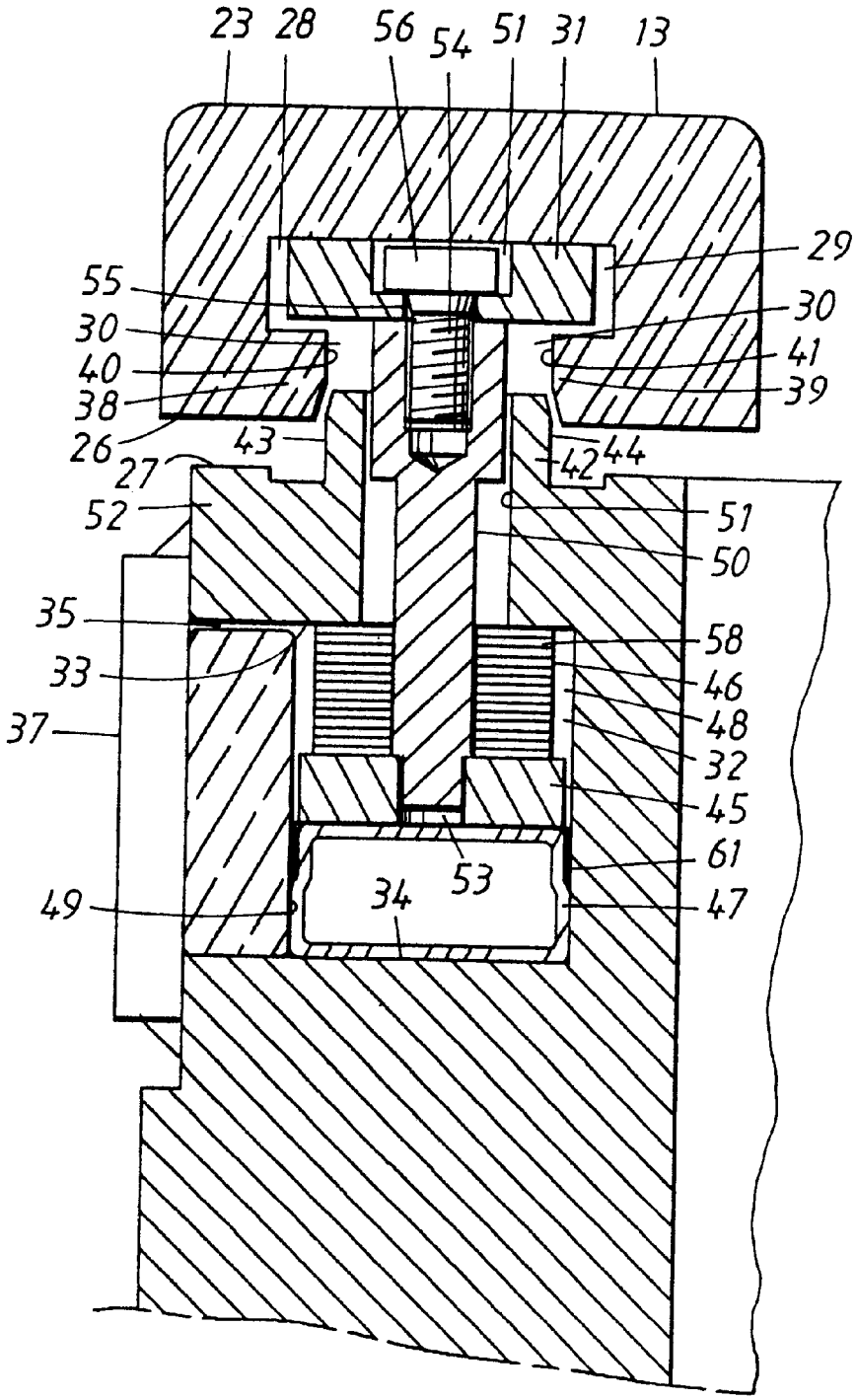
FIG. 4 is an enlargement of the left part of the cross section in FIG. 3.

With reference to FIGS. 2 and 3, each suction device 7, 10, 11 comprises two elongated stable support bodies 20, 21, forming the side walls of the suction device and defining between them a vacuum chamber 22, and two elongated, ledge-shaped wear bodies 23, 24, having a free wear surface 13, 14, with which the movable clothing 4, 8 is in sliding contact. The wear ledges 23, 24 define between them a suction gap 25 communicating directly with said vacuum chamber 22. The wear ledges 23, 24 are parallel to each other and supported by individual support bodies 20, 21. The wear ledges 23, 24 and associated support bodies 20, 21 have respective free support surfaces 26, 27 facing each other and designed to abut each other closely when the suction device is in its operative position. Each wear ledge 23, 24 and associated support body 20, 21 is provided with a device for detachably mounting the wear ledge 23, 24 to the support body 20, 21. The wear ledge 23, 24 has a continuous T-shaped mounting track or groove 28 extending in the cross-machine direction between the two ends of the wear ledge 23, 24 and consisting of an inner groove part 29 and an outer groove part 30, opening in the direction towards the support body 20, 21, the inner groove part 29 being wider than the outer groove part 30.

The mounting device includes a stable locking bar 31 arranged in the inner groove part 29, which locking bar 31 is arranged with its ends a short distance from the ends of the wear ledge, as illustrated in FIG. 2. The locking bar 31 is configured to be freely slidable in the cross-machine direction within the inner groove part 29 so that the wear ledge can readily be slid in the cross-machine direction along the locking bar 31 when the locking bar is inactivated as further described below. The support body 20, 21 is provided with an elongate cavity 32 extending therethrough in the cross-machine direction between the end sections of the support body 20, 21. The cavity 32 defines first (outer) and second (inner) support surfaces 33, 34 that are parallel to and spaced predetermined distances from the free support surface 27 of the support body. The cavity 32 is accessible from the outer long side of the support body 20, 21 via an elongated side opening 35, which is covered by a protective strip 36 while the suction box is operating. The protective strip 36 is retained in position by a plurality of transverse ribs 37 rigidly mounted to the support body 20, 21 at evenly spaced points along it.

Each pair of wear ledges 23, 24 and support body 20, 21 have cooperating guide elements to guide the wear ledge 23, 24 and support body 20, 21 into engagement with each other and to secure the lateral position of the wear ledge in relation to the support body during operation. In the embodiment shown, the guide element of the wear ledge 23, 24 is formed by two wall sections 38, 39 that define the outer groove part 30 between their opposite side surfaces 40, 41, which outer groove part 30 thus constitutes a guide groove. The guide element of the support body 20, 21 comprises a protrusion 42 from the free support surface 27, which protrusion 42 constitutes a guide ridge with side surfaces 43, 44 facing away from each other and arranged to cooperate with the side surfaces 40, 41 of the guide groove to guide, secure and center the wear ledge with respect to the support body. The outermost parts of said four side surfaces are complementarily beveled outwardly and inwardly, respectively, to facilitate guiding the wear ledge 23, 24 on to the support body 20, 21 and to create a wedge joint therebetween. The guide ridge 42 has an elevation that is slightly shorter than the depth of the guide groove 30 to prevent contact with the locking bar 31 and, instead, to secure the desired close contact between the facing support surfaces 26, 27 of the wear ledge 23, 24 and the support body 20, 21 by way of the locking bar 31 being pulled and clamped against said wall sections 38, 39 by a spring force as will be explained below.

The longitudinal cavity 32 in the support body forms an assembly space for a rigid, elongated press bar 45, a plurality of spring members 46 and an actuator 47, wherein the spring members 46 and the actuator 47 are arranged on opposite sides of the press bar 45, which thus divides the assembly space 32 into a first (outer) part 48 and a second (inner) part 49.

The locking bar 31 and the press bar 45 are connected to each other by way of a plurality of connecting elements 50 to create a unit which is movable and displaceable in parallel relative to the support body 20, 21. Each connecting element 50 is thus rigidly mounted to the locking bar 31 and to the press bar 45 and is arranged in an opening or hole 51, extending from the cavity 32, through the guide ridge 42 and the outer part of the support body 20, 21, and opens in line with the outer groove part 30 of the wear ledge 23, 24. Each connecting element 50 is in the shape of a rod with one end part being externally threaded to thus engage a threaded hole 53 in the press bar 45 and the other end part being internally threaded for a thread tap 54 extending through a hole 55 in the locking bar 31 to receive a nut 56, which rests in a recess 57 in the locking bar 31 and which is turned until a rigid joint is obtained.

The spring members 46 are arranged, in a number corresponding to the number of connecting elements 50, near the connecting elements 50 to abut against the press bar 45 and the opposite outer support surface 33 of the assembly space 32 while exerting a predetermined spring force therebetween. The spring members 46 are thus compressed in the outer cavity part 48. In the embodiment shown, each spring member 46 consists of a plurality of dome-shaped spring washers 58, arranged in pairs with the concave sides of the two spring washers 58 facing each other. The connecting rod 50 extends through the central hole of the spring washers 58. Alternatively, the spring members may consist of coil springs.

In the embodiment shown, the actuator 47 consists of an expandable, elastic hose, which is connected at one of its ends via a valve (not shown) to a pneumatic or hydraulic pressurizing source. The other end of the hose 47 is provided with a nipple 59 rigidly mounted to the short end of the support body 20, 21. The nipple 59 is sealed with a screw cap 60. The expandable hose 47, which forms part of said mounting device, is arranged in the inner cavity part 49 so as, when activated, to press against the press bar 45 with a force that is greater than the combined spring force of the spring washers 58 such that the wear ledge is displaced away from the support body 20, 21. This causes the locking bar 31 to be moved within the mounting track 28 in the wear ledge in a direction toward the clothing (away from the support body 20, 21) so as to become disengaged from the clamping surfaces defined by the wall sections 38, 39. The wear ledge thus becomes completely free from contact with the support body 20, 21 and ample play is created for the locking bar 31 in the inner T-groove part 29, such that the wear ledge 23, 24 can without difficulty be pulled off the locking bar and be replaced with a new one. The hose 47, likewise easily replaceable when the need arises, is suitably made of silicone rubber. To prevent clamping damage to the hose 47 when the press bar 45 returns, thereby compressing the hose 47, a protective strip 61 is applied to the side of the press bar 45 which faces the hose 47 and made to extend a distance down into the inner cavity part 49 to partially surround the hose 47.

The invention enables high tolerance to be obtained between cooperating surfaces so that the wear ledge is secured to the support body during operation in a steady way completely free of play. The wear ledge thereby becomes completely free from vibrations and, in the case of a suction gap, a desired, set width can be maintained during operation along the entire suction gap.

Although an expandable hose is the currently most preferred embodiment of the actuator, it may, in accordance with alternative embodiments, comprise a pressure chamber formed in a portion of the cavity 32, an eccentric shaft disposed in the cavity 32, or a plurality of small hydraulic or pneumatic power cylinders. Where the actuator comprises a pressure chamber, the inner cavity part 49 is preferably sealed at both ends, and a sealing wall is substituted for the protective strip 61, and the press bar 45 is provided with seals so that the requisite pressure can be maintained in the pressure chamber, which is connected to a pressurizing source. In the embodiment involving an eccentric shaft, the shaft is rotatably journalled in the inner cavity part 49 to extend through the same and its eccentric surfaces act on the press bar 45 to move the same against the force of the spring members 46. In the embodiment involving power cylinders, these are suitably arranged in the inner cavity part 49 in proximity to the spring members 46. Each piston-rod can be connected to or form part of the connecting rod 50, in which case the piston-rod carries the press bar 45 in an appropriate way.

The invention is also applicable for machine equipment other than the above-described, e.g., for foils and carrying and support ledges for a clothing.

Many modifications and other embodiments of the invention will come to mind to one skilled in the art to which this invention pertains having the benefit of the teachings presented in the foregoing descriptions and the associated drawings. For example, although the illustrated embodiment of the invention has the locking bar 31, support body 20, 21, and wear ledge 23, 24 arranged such that the locking bar 31 and wear ledge are retracted toward the support body to lock the wear ledge in the operating position, and the locking bar and wear ledge are extended away from the support body to free the wear ledge for removal, it will be recognized that the components can alternatively be configured such that the locking bar and wear ledge are extended away from the support body to lock the wear ledge in the operating position and are retracted toward the support body to free the wear ledge for removal. In either arrangement, spring members continuously urge the wear ledge into the stable operating position, and an actuator is activated to release the wear ledge for removal. It will also be recognized that although the connecting elements 50 in the illustrated embodiment are removably connected to the locking bar 31 and to the press bar 45, in some applications it may be possible or advantageous to provide connecting elements that are integrally formed with the locking bar 31 and/or with the press bar 45 such that these elements form a unit that can be moved by spring force to lock the wear ledge in its operating position and can be moved by one or more actuators to unlock the wear ledge for removal. It will also be appreciated that although the illustrated embodiment has a locking bar 31 that is an elongate one-piece structure extending along the cross-machine direction, in some applications it may be possible or advantageous to employ a locking member that is formed in two or more discrete sections each of which is slidable within a mounting track in the wear ledge and is attached by an integral or removably attached connecting element to a locking device in the support body. Other modifications to the illustrated embodiment can also be made within the scope of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for slidably contacting a clothing that carries a paper web and travels in a loop along a machine direction in a paper making machine, the apparatus comprising:

an elongate support body extending in a cross-machine direction, the support body defining at least one cavity therein and at least one opening that extends into the cavity and is open facing the clothing;

an elongate wear body supported on the support body and extending in the cross-machine direction, the wear body and support body defining opposing cooperative support surfaces, a wear surface of the wear body being adapted to slidably contact the clothing, the wear body defining a mounting track therein extending in the cross-machine direction, the mounting track defining clamping surfaces therein;

a locking member engaged in the mounting track of the wear body, the locking member being configured to be movable toward and away from the support body between a clamped position in engagement with the clamping surfaces of the mounting track and a release position disengaged from the clamping surfaces, the locking member in the release position being freely slidable within the mounting track in the cross-machine direction; and at least one locking device disposed in the cavity of the support body and having at least one connecting element extending through the opening and connected to the locking member, the connecting element being movable toward and away from the wear body, the locking device including a spring member connected between the support body and the connecting element and operable to apply a continuous force to the connecting element so as to bias the locking member into the clamped position in engagement with the clamping surfaces and thereby urge the wear body against the support surface of the support body to lock the wear body in a stable operating position, the locking device further including an actuator disposed in the cavity of the support body and operable upon actuation thereof to move the connecting element against the force of the spring member so as to move the locking member into the release position to permit the wear body to be slidably dismantled from the apparatus.

2. The apparatus of claim 1, wherein the cavity in the support body is elongated in the cross-machine direction, wherein a plurality of openings are defined in the support body extending from the cavity and open toward the clothing, the openings being spaced along the support body in the cross-machine direction, and wherein the locking device includes an elongate press bar disposed in the cavity and a plurality of connecting elements connected to the press bar and extending through the openings in the support body and connected to the locking member.

3. The apparatus of claim 2, wherein the locking device includes a spring member connected between each connecting element and the press bar for continuously biasing the connecting elements to urge the locking member into the clamped position.

4. The apparatus of claim 3, wherein the support surface of the support body faces toward the clothing and the support surface of the wear body faces away from the clothing, and wherein the locking device is operable to retract the locking member away from the clothing to lock the wear body in a stable operating position and to extend the locking member toward the clothing to permit the wear body to be removed from the apparatus.

5. The apparatus of claim 4, wherein the spring members comprise compression spring members disposed between a first surface of the press bar that faces the wear body and a surface of the support body that faces away from the wear body.

6. The apparatus of claim 5, wherein the actuator is disposed between a second surface of the press bar that faces away from the wear body and a surface of the support body that faces toward the wear body.

7. The apparatus of claim 1, wherein the actuator comprises a fluid-actuated device.

8. The apparatus of claim 1, wherein the spring member comprises a plurality of spring washers stacked one atop another.

9. The apparatus of claim 1, wherein the wear body and the support body include cooperating guide elements configured to engage each other and guide the wear body into the operating position, the guide elements also fixing the wear body in a predetermined position in the machine direction relative to the support body.

10. The apparatus of claim 9, wherein the guide element of the wear body comprises a pair of wall sections defining opposing side surfaces spaced apart in the machine direction, the side surfaces defining an outer portion of the mounting track, and wherein the guide element of the support body comprises a protrusion formed on the support body and configured to be received at least partially into the outer portion of the mounting track, the protrusion including opposite side surfaces configured to engage the side surfaces of the wall sections.

11. The apparatus of claim 10, wherein the wear body defines an inner portion of the mounting track spaced from the outer portion thereof in a direction toward the clothing, the inner portion having a width in the cross-machine direction greater than that of the outer portion, and wherein the locking member comprises an elongate locking bar having a width in the cross-machine direction greater than that of the outer portion of the mounting track.

12. The apparatus of claim 11, wherein the cavity extends through the support body in the cross-machine direction and the support body defines a plurality of openings spaced along the cross-machine direction and extending from the cavity toward and in alignment with the outer portion of the mounting track of the wear body, and wherein the locking device comprises an elongate press bar disposed in the cavity so as to separate the cavity into an inner portion and an outer portion, a plurality of connecting elements connected to the press bar and extending through the openings and through the outer portion of the mounting track and connected to the locking bar, a plurality of compression spring elements disposed in the outer portion of the cavity for exerting a continuous retraction force on the press bar urging the locking bar into the clamped position, and an actuator disposed in the inner portion of the cavity and operable upon actuation to forcibly move the press bar against the force of the spring elements so as to move the locking bar into the release position.

13. The apparatus of claim 1, wherein the connecting element is removably attached to the locking member.

14. A method for mounting and removing an elongate wear body adapted to slidably contact a clothing that travels in a loop along a machine direction in a paper making machine, the wear body being of the type defining an elongate mounting track therein extending through at least one end of the wear body and along the wear body in a cross-machine direction and defining a wear surface adapted to slidably contact the clothing, the mounting track defining clamping surfaces therein, the mounting track defining an outer portion that is open at a surface of the wear body on an opposite side thereof from the wear surface, the method comprising:

mounting the wear body by slidably inserting an elongate locking member into the mounting track, and continuously urging the wear body into engagement with an elongate support body configured to support the wear body in a stable operating position, the wear body being urged into the operating position by spring elements connected to the support body and to the locking member, the spring elements urging the locking member against the clamping surfaces so as to lock the wear body in the operating position; and dismantling the wear body by actuating an actuator in operative engagement with the locking member so as to move the locking member against the force of the spring elements and disengage the locking member from the clamping surfaces, and sliding the wear body in the cross-machine direction relative to the locking member so as to disengage the wear body from the locking member.

* * * * *